United States Patent [19]

Richard

[11] Patent Number: 4,718,630

[45] Date of Patent: Jan. 12, 1988

[54] PORTABLE READING IN BED BOOK HOLDER AND LAP WRITING SURFACE

[76] Inventor: Betty A. Richard, 5815 Magnolia, Commerce City, Colo. 80022

[21] Appl. No.: 933,175

[22] Filed: Nov. 21, 1986

[51] Int. Cl.[4] ..... A47B 97/04

[52] U.S. Cl. ..... 248/444.1; 108/1; 108/19; 248/163.1; 248/188.2; 248/432; 248/445; 248/454

[58] Field of Search ..... 248/444.1, 445, 446, 248/454, 163.1, 432, 440.1, 188.2, 188.8; 108/19, 1, 4, 156

[56] References Cited

U.S. PATENT DOCUMENTS

| | | | |
|---|---|---|---|
| 2,448,734 | 9/1948 | Phillips | 248/444.1 X |
| 2,546,283 | 3/1951 | Webster | 248/444.1 X |
| 3,261,584 | 7/1966 | Miller | 248/188.2 |
| 3,664,629 | 5/1972 | Reed | 248/454 X |
| 3,740,015 | 6/1973 | Adams | 248/454 X |
| 4,119,289 | 10/1978 | Kanocz | 248/454 |
| 4,313,589 | 2/1982 | Vega | 248/444.1 |
| 4,465,255 | 8/1984 | Hill | 248/445 X |
| 4,496,125 | 1/1985 | Walsh et al. | 248/188.8 X |

FOREIGN PATENT DOCUMENTS

| | | | |
|---|---|---|---|
| 1525080 | 9/1978 | United Kingdom | 248/444.1 |

*Primary Examiner*—Ramon O. Ramirez
*Attorney, Agent, or Firm*—Klaas & Law

[57] ABSTRACT

A portable supporting device is provided and has a frame having an upper and lower surface with a transparent sheet member secured in a recess in the upper surface and a plurality of hollow tubes providing leg mounting means on the lower surface of the frame adjacent each corner thereof with four of the hollow tubes cooperating when legs are provided therein to form a portable table for supporting a book for reading in bed and a different four of the hollow tubes cooperating when legs are provided therein to form a table for providing a portable lap writing surface.

20 Claims, 19 Drawing Figures

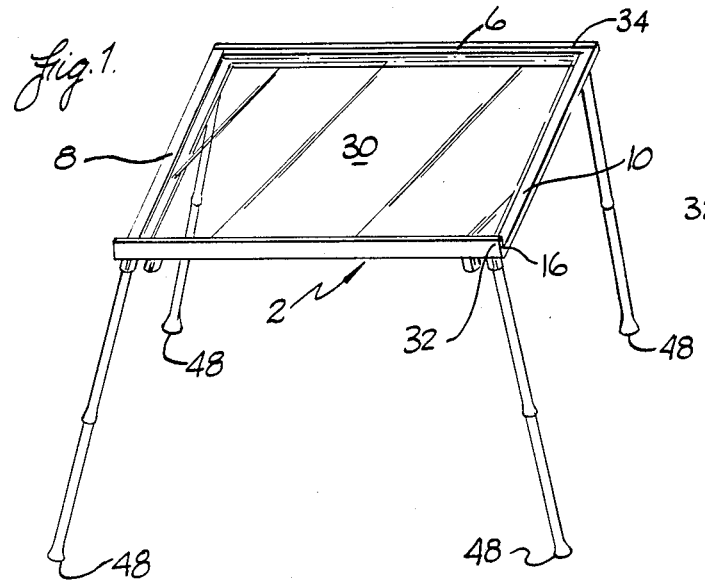
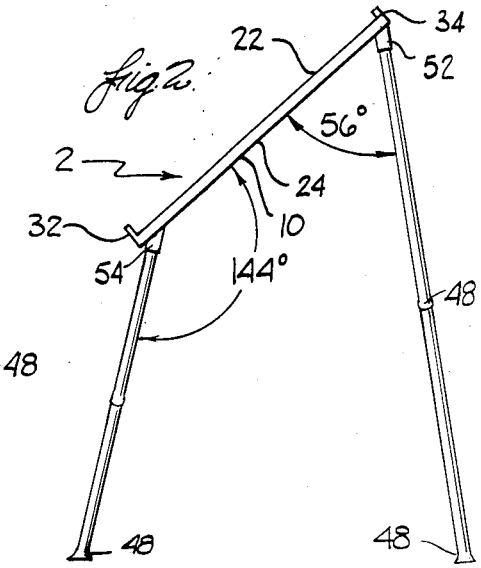
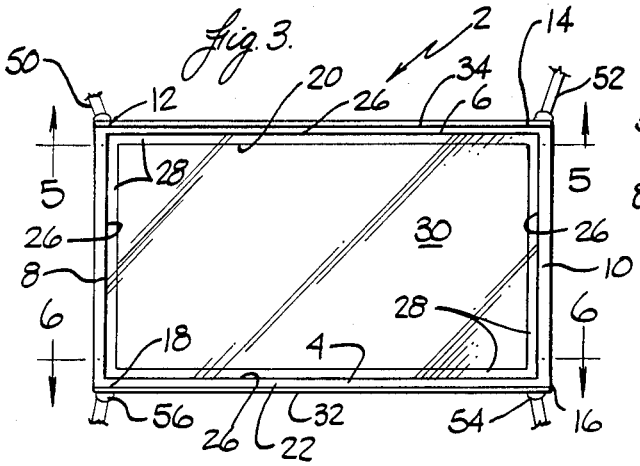
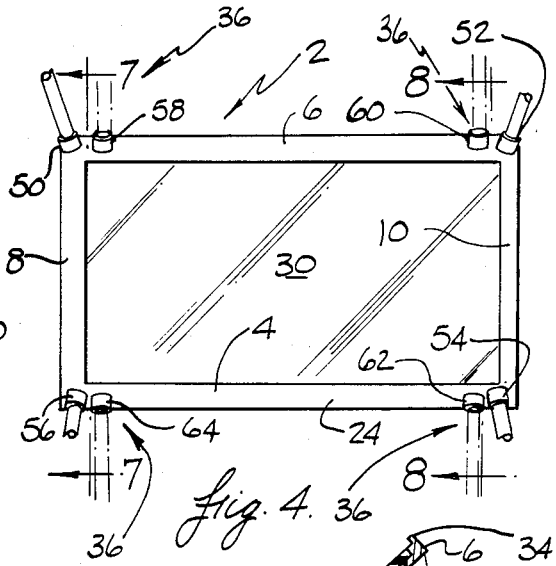
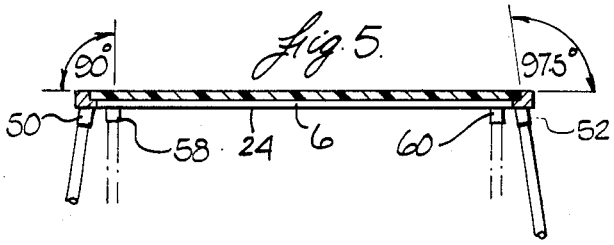
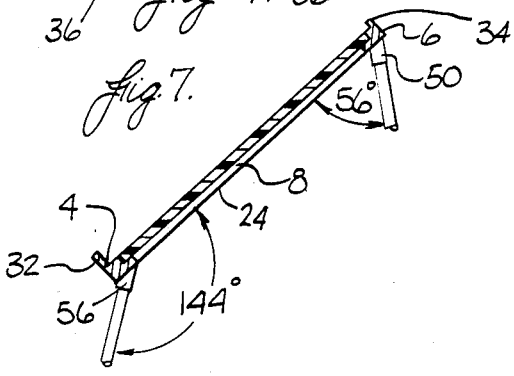
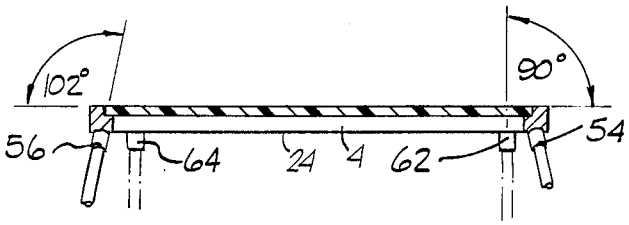
Fig. 6.
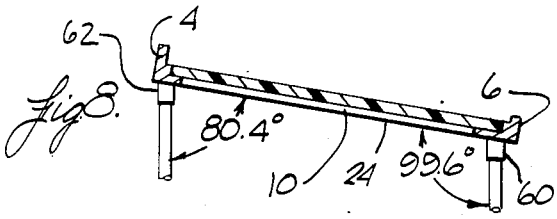

PORTABLE READING IN BED BOOK HOLDER AND LAP WRITING SURFACE

FIELD OF THE INVENTION

This invention relates generally to portable supporting devices and more particularly to a portable supporting device that is provided with leg mounting devices so that the supporting device may be readily used as a book holder for reading in bed or as a lap writing surface.

BACKGROUND OF THE INVENTION

For many people, the most enjoyable method of reading a book is while lying in bed. For some invalids or otherwise incapacitated people, that is their only way for reading. One problem associated with reading in bed is the inconvenience related to the holding of the book. Many solutions have been suggested throughout the years in efforts to solve the problem. This problem greatly increases when it is desirable to move a book holding apparatus from one location to another location. While not directly associated with a book holding apparatus, it is often desirable to have a writing surface available in instances such as sitting on a couch or riding in a car. Therefore, it is most important in providing solutions to these problems that there be one readily portable device that can conveniently be made into a table for holding a book for reading in bed or be made into a writing surface that can be positioned across a person's lap.

BRIEF DESCRIPTION OF THE INVENTION

This invention provides an integrally molded plastic frame having a transparent panel secured therein and a plurality of leg mounting means so that the frame and transparent panel may readily be provided with legs so that it can be used as a supporting device for holding a book for reading in bed or be readily provided with legs to serve as a lap writing surface.

The apparatus of a preferred embodiment of the invention comprises an integrally molded plastic generally rectangular frame having a central opening, a length greater than its width, and an upper and lower surface. An inner recess is formed in the upper surface to form a generally rectangular support ledge surrounding the central opening. A transparent sheet member, formed from glass or a plastic, such as plexiglass, is positioned on the support ledge and secured thereto by any suitable means, such as an adhesive. The frame has two lengthwise extending side members and two widthwise extending side members. A first lengthwise extending support flange projects upwardly from the upper surface of one of the two lengthwise extending side members for an upward distance of about one inch and is adapted to have a book positioned thereagainst. A second lengthwise extending support flange projects upwardly from the upper surface of the other of the two lengthwise extending sid members for an upward distance of about one-half inch. This second support flange will hold paper and pencil when the apparatus is used as a writing surface. In changing from a book holding position to a lap writing position, the frame is rotated one-half of a turn.

The two lengthwise extending side members are joined to the two widthwise extending side members to provide the frame with four corners. A plurality of leg mounting means project downwardly from the lower surface of the two side members adjacent to each corner. Each of the leg mounting means has a cross-sectional configuration adapted to mate with a cross-sectional configuration on one end of a leg so that the one end of a leg will be frictionally retained therein. Four of the leg mounting means, one in each corner, have an angular relationship with the lower surface of the frame so that when legs of the proper length are secured thereto, the transparent sheet member may be used to support a book at a proper location for reading in bed. Another four of the leg mounting means, one in each corner, have an angular relationship with the lower surface of the frame so that when legs of the proper length are secured thereto, the transparent sheet member may be used to provide a lap writing surface. The legs are readily removable so that the apparatus can be easily dismantled and is compact enough to fit in a suitcase for travelling from one location to another.

It is an object of this invention to provide a portable supporting device that is readily convertible to serve as a book holder for reading in bed or as a writing surface to be positioned across the lap of a person and many other uses.

Additional objects, advantages, and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

BRIEF DESCRIPTION OF THE DRAWING

FIG. 1 is a pictorial view of apparatus made in accordance with this invention;

FIG. 2 is a side elevation of FIG. 1;

FIG. 3 is a top plan view of a portion of FIG. 1;

FIG. 4 is a bottom plan view of FIG. 1;

FIG. 5 is a cross-sectional view taken on the line 5—5 of FIG. 3;

FIG. 6 is a cross-sectional view taken on the line 6—6 of FIG. 3;

FIG. 7 is a cross-sectional view taken on the line 7—7 of FIG. 4 and illustrating the use as support for reading in bed;

FIG. 8 is a cross-sectional view taken on the line 8—8 of FIG. 4 and illustrating the use as a writing surface across a lap;

DETAILED DESCRIPTION OF THE INVENTION

Figure 9:
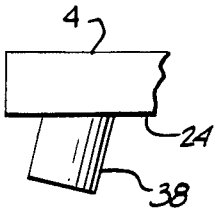
FIG. 9 is a side elevational view of a portion of the apparatus and illustrates one of the leg mounting tubes.

A preferred embodiment of the invention is illustrated in the drawings and comprises an integrally molded frame 2 using a suitable plastic material such as a high density polyethylene. As illustrated in FIGS. 1, 3 and 4, the frame 2 has a length greater than its width and has two lengthwise extending side members 4 and 6 and two widthwise extending side members 8 and 10 integrally joined together so a to provide the frame 2 with four corners 12, 14, 16 and 18 and a central opening 20 defined by the innermost portions of the side members 4, 6, 8 and 10. The frame 2 and therefore the side members 4, 6, 8 and 10 have an upper surface 22 and a generally planar lower surface 24. The lower surfaces 24 of the side member 4, 6, 8 and 10 lie in the same plane. Each of the side members 4, 6, 8 and 10 is provided with a longitudinally extending recess 26 extending downwardly from its upper surface 22 so as to form a support ledge 28 surrounding the central opening 20. A transparent sheet member 30, formed from a suitable material such as plexiglass, is dimensioned so as to fit between the side members 4,6, 8 and 10 and to be positioned on and supported by the supporting ledge 28. The transparent sheet member 30 is secured in position on the supporting ledge 28 by suitable means such as an adhesive.

The side member 4 is provided with a support flange 32 which extends upwardly from the upper surface 22 thereof for a distance of about one inch. The support flange 32 extends for the full length of the side member 4. As described below, the support flange 32 is used to locate a book in a proper position. The side member 6 is provided with a support flange 34 which extends upwardly from the upper surface 22 thereof for distance of about one-half inch and extends for the full length of the side member 6. As described below, the support flange 34 is used to retain materials at a proper location in many uses.

Figure 10:
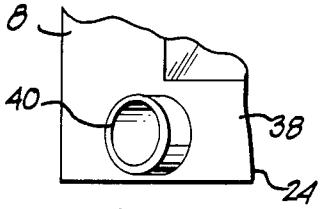
FIG. 10 is a bottom plan view of FIG. 9.
Figure 11:
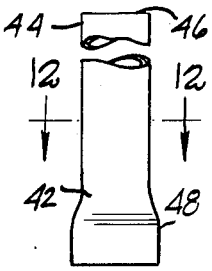
FIG. 11 is a side elevational view with parts removed of a leg for use in this invention.
Figure 12:
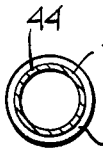
FIG. 12 is a cross-sectional view taken on the line 12—12 of FIG. 11.
Figure 13:
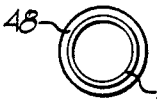
FIG. 13 is a bottom plan view of FIG. 11.

As illustrated in the drawings, the frame is provided with a plurality of leg mounting means 36 located in each of the corners 12, 14, 16 and 18. As illustrated in FIGS. 9 and 10, each of the leg mounting means 36 comprises a hollow tube 38 integrally formed with the frame 2 and having a generally cylindrical inner surface 40. The hollow tube 38 projects downwardly from the bottom surface 24 for a distance of about one inch. In FIGS. 11–13, there is illustrated a hollow leg 42 having a generally cylindrical outer surface 44 adjacent one end 46 thereof. The diameter of the generally cylindrical outer surface 44 is slightly smaller than the diameter of the generally cylindrical inner surface 40 of the hollow tube 38 so that when the one end 46 is inserted into the hollow tube 38, there will be a frictional fit therebetween so as to retain the one end 46 in the hollow tube 38. The other end 48 of the leg 42 is flared outwardly so that the inner diameter thereof is slightly greater than the diameter of the generally cylindrical outer surface 44 so that one leg can be mounted on another leg.

As illustrated in FIGS. 3–8, the hollow tubes 38 are integrally molded with the frame 2 so that the longitudinal axes have a desired angular relationship with the lower surface 24 of the side members 4, 6, 8 and 10. In the preferred embodiment of the invention, the four outer hollow tubes 50, 52, 54 and 56 cooperate to support the frame 2 in a relationship so that it can be used to support a book for reading in bed, as described below. The four inner hollow tubes 58, 60, 62 and 64 cooperate to support the frame 2 in a relationship so that it can be used as a writing surface positioned across a lap, as described below.

The angular relationship of the outer hollow tubes 50, 52, 54 and 56 is illustrated in FIGS. 5–7. The included angle between the longitudinal axis of the outer hollow tubes 50 and 52, illustrated in FIG. 5, and the lower surface 24 of the side member 6 is between about 92.5 degrees and 102.5 degrees and preferably is about 97.5 degrees. The included angle between the longitudinal axis of the outer hollow tubes 54 and 56, illustrated in FIG. 6, and the lower surface 24 of the side member 4 is between about 97 degrees and 107 degrees and preferably is about 102 degrees. The included angle between the longitudinal axis of the outer hollow tube 50, illustrated in FIG. 7, and the lower surface 24 of side member 8 is between about 51 degrees and 61 degrees and preferably is about 56 degrees. The included angle between the longitudinal axis of the outer hollow tube 52 and the lower surface 24 of side member 10 is also between about 51 degrees and 61 degrees and preferably is about 56 degrees (not shown). The included angle between the longitudinal axis of the outer hollow tube 56, illustrated in FIG. 7 and the lower surface 24 of the side member 8 is between about 139 degrees and 149 degrees and preferably is about 144 degrees. The included angle between the longitudinal axis of the outer hollow tube 54 and the lower surface 24 of the side member 10 is between about 139 degrees and 149 degrees and preferably is also about 144 degrees (not shown).

The angular relationship of the inner hollow tubes 58, 60, 62 and 64 is illustrated in FIGS. 5–7. The included angle between the longitudinal axis of the inner hollow tubes 58 and 60, illustrated in FIG. 5, and the lower surface 24 of the side member 6 is between about 89 degrees and 91 degrees and preferably is about 90 degrees. The included angle between the longitudinal axis of the inner hollow tubes 62 and 64, illustrated in FIG. 6, and the lower surface 24 of the side member 4 is between about 89 degrees and 91 degrees and preferably is about 90 degrees. The included angle between the longitudinal axis of the inner hollow tube 62, illustrated in FIG. 8, and the plane in which the lower surface 24 of side member 10 lies is between about 75.4 degrees and 85.4 degrees and preferably is about 80.4 degrees. The included angle between the longitudinal axis of the inner hollow tube 64 and the plane in which the lower surface 24 of side member 8 lies is between about 75.4 degrees and 85.4 degrees and preferably is also about 80.4 degrees (not shown). The included angle between the longitudinal axis of the inner hollow tube 60, illustrated in FIG. 8, and the plane in which the lower surface 24 of the side member 10 lies is between about 94.6 degrees and 104.6 degrees and preferably is about 99.6 degrees. The included angle between the longitudinal axis of the inner hollow tube 58 and the plane in which the lower surface 24 of the side member 8 lies is between about 94.6 degrees and 104.6 degrees and preferably is also about 99.6 degrees (not shown).

Figure 14:
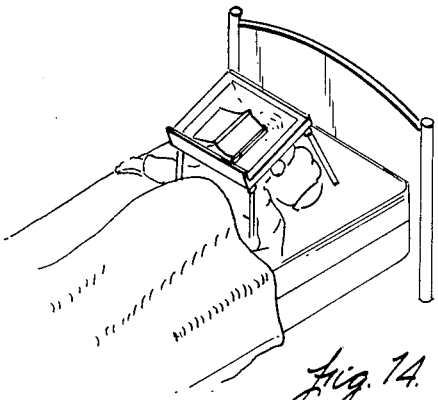
FIGS. 14–19 pictorial views showing different uses of the apparatus of this invention.

In order to accommodate the various uses described in FIGS. 14–19, a set of eight legs 42 will be provided with each frame 2. The set will include two legs each having a length of four inches, two legs, each having a length of nine inches, two legs each having a length of ten inches and two legs each having a length of eleven inches. In FIGS. 1 and 14, the frame 2 is being used to support a book for reading in bed. The side member 6 is supported a distance above the bed by using a ten inch and a eleven inch leg with each of the outer hollow tubes 50 and 52. The side member 4 is supported a distance above the bed by using a four inch and a nine inch leg with each of the outer hollow tubes 54 and 56. As illustrated, the book is positioned on the transparent sheet member 30 with the printed pages facing downwardly. The support flange 32 prevents the book from falling off the frame 2.

Figure 15:
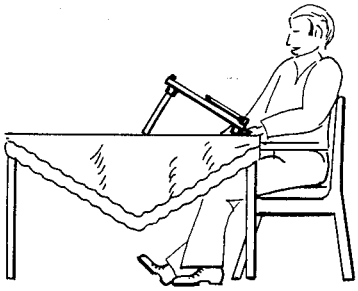

In FIG. 15, the frame 2 is being used to hold a book while the reader is seated at a table. A nine inch leg is inserted in the outer hollow tubes 50 and 52 to support the side member 6 above the table while the side member 4 is supported above the table by the inner hollow tubes 62 and 4. The support flange 32 prevents the book from falling off the frame.

Figure 16:
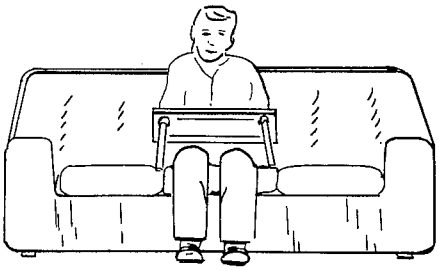

In FIG. 16, the frame 2 is being used to support a book while sitting on a couch. The side member 4 is supported a distance from the couch by inserting an eleven inch leg in each of the inner hollow tubes 62 and 64 and the side member 6 is supported a distance from the couch by inserting a nine inch leg in each of the inner hollow tubes 58 and 60. The support flange 34 prevents the book from falling off the frame 2.

Figure 17:
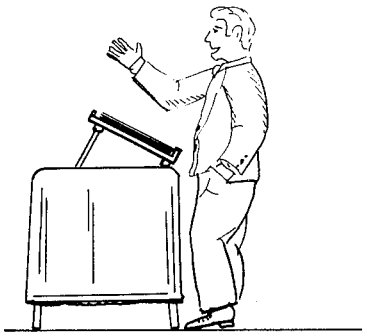

In FIG. 17, the frame 2 is being used to hold notes for a speaker. A nine inch leg is inserted in the outer hollow tubes 50 and 52 to support the side member 6 above the table while the side member 4 is supported above the table by the inner hollow tubes 62 and 64. The support flange 32 prevents the notes from falling off the frame 2.

Figure 18:
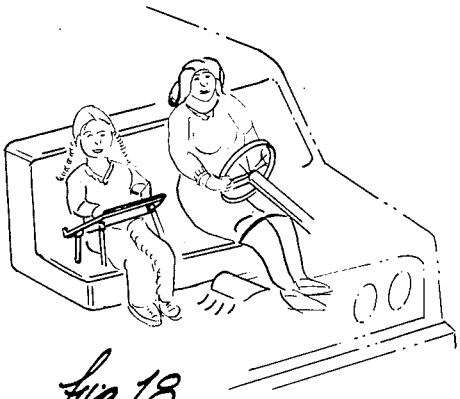

In FIG. 18, the frame 2 is being used to form a writing surface positioned across a lap of a user. The side member 4 is supported a distance from the car seat by inserting an eleven inch leg in each of the inner hollow tubes 62 and 64 and the side member 6 is supported a distance from the car seat by inserting a nine inch leg in each of the inner hollow tubes 58 and 60. The support flange 34 prevents writing equipment from falling off the frame 2.

Figure 19:
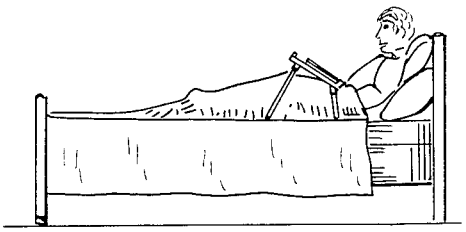

In FIG. 19, the frame 2 is being used for supporting a book while the user is sitting up in a bed. The side member 6 is supported above the surface of the bed by using an eleven inch and a four inch leg with each of the outer hollow tubes 50 and 52. The side member 4 is supported above the surface of the bed by inserting a nine inch leg in each of the outer hollow tubes 54 and 56. The support flange 32 prevents the book from falling off the frame 2.

In a preferred embodiment of the invention, the frame 2 has a length of about 19 inches, a width of about 14 inches and the transparent sheet member has a length of about 18 inches, a width of about 12 inches and a thickness of about 0.125 inches. Each of the side members 8 and 10 has a thickness of about 0.25 inch, an upper surface width of about 0.50 inch and a lower surface width of about 0.625 inch and the recess has a depth of about 0.125 inch and a width of about 0.125 inch so that the support ledge 28 has a width of about 0.125 inch. Each of the side members 4 and 6 has a thickness of about 0.25 inch, an upper surface width of about 1.0 inch, a lower surface width of about 1.125 inches and the recess has a depth of about 0.125 inch and a width of about 0.125 inch so that the support ledge 28 has a width of about 0.125 inch. The support flange 32 extends upwardly for a distance of about 1.0 inch and has a thickness of about 0.125 inch. The support flange 34 extends upwardly for a distance of about 0.50 inch and has a thickness of about 0.125 inches. Each hollow tube 38 has a longitudinal extent of about 1.250 inches, an outer diameter of about 0.75 inch and an inner diameter of about 0.625 inch. Each leg 42 has an outer diameter of about 0.625 inch and an inner diameter of about 0.50 inch.

It is contemplated that the inventive concepts herein described may be variously otherwise embodied and it is intended that the appended claims be construed to include the alternative embodiments of the invention except insofar as limited by the prior art.

What is claimed is:

1. Apparatus for use as a portable supporting device comprising:

a generally rectangularly shaped frame having a central opening and a length greater than its width; said frame having an upper surface and a lower surface;

an inner recess formed in said upper surface of said frame to provide a generally rectangular support ledge surrounding said central opening;

a transparent sheet member positioned on said support ledge and secured thereto;

said frame having at least four side members, two of which extend in a lengthwise direction and two of which extend in a widthwise direction;

said two lengthwise extending side members and said two widthwise extending side members being joined together to form four corners;

a plurality of fixedly mounted leg mounting means projecting downwardly from said lower surface of said frame adjacent to each of said four corners;

four of said leg mounting means cooperating for use of said apparatus for one purpose and comprising;

a first pair of leg mounting means each having an included angle between its longitudinal axis and the lower surface of each of said two widthwise extending side members of x degrees and an included angle between its longitudinal axis and the lower surface of one of said two lengthwise extending side members of x1 degrees;

a second pair of leg mounting means each having an included angle between its longitudinal axis and the lower surface of each of said two widthwise extending side members of x2 degrees and an included angle between its longitudinal axis and the other of said two lengthwise extending side members of about x3 degrees;

four of said leg mounting means cooperating for use of said apparatus for a different purpose and comprising;

a third pair of leg mounting means each having an included angle between its longitudinal axis and the lower surface of each of said two widthwise extending side members of x4 degrees and an included angle between its longitudinal axis and the lower surface of one of said two lengthwise extending said members of x5 degrees;

a fourth pair of leg mounting means each having an included angle between its longitudinal axis and the lower surface of each of said two widthwise extending side members of x6 degrees and an included angle between its longitudinal axis and the other of said two lengthwise extending side members of about x5 degrees;

each of said x, x1, x2, x3, x4, x5 and x6 degrees being a different number; and a leg secured to at least two of said leg mounting means at said corners.

2. Apparatus as in claim 1 and further comprising:

a first lengthwise extending support flange projecting upwardly from the upper surface of one of said lengthwise extending side members; and a second lengthwise extending support flange projecting upwardly from the upper surface of the other of said lengthwise extending side members.

3. Apparatus as in claim 2 wherein:

said first lengthwise extending support flange projects upwardly for a distance greater than that of the second lengthwise extending support flange.

4. Apparatus as in claim 1 wherein:

said frame is integrally molded using a high density plastic material.

5. Apparatus as in claim 1 wherein each of said leg mounting means comprises:

a hollow tube having an inner cross-sectional configuration similar to but slightly larger than the outer cross-sectional configuration of said leg so that one end portion of said leg may be inserted into said hollow tube and be frictionally retained therein.

6. Apparatus as in claim 5 wherein:

said first pair of hollow tubes each having an included angle between its longitudinal axis and the lower surface of each of said two widthwise extending side members of between about 139 degrees and 149 degrees and an included angle between its longitudinal axis and the lower surface of one of said two lengthwise extending side members of between about 97 degrees and 107 degrees;

said second pair of hollow tubes each having an included angle between its longitudinal axis and said lower surface of each of said two widthwise extending side members of between about 51 degrees and 61 degrees and an included angle between its longitudinal axis and the lower surface of the other of said two lengthwise extending side members of between about 92.5 degrees and 102.5 degrees; and a leg in each of said first and second pairs of hollow tubes so that said transparent panel may be used as a book holder for reading in bed.

7. Apparatus as in claim 5 wherein:

said first pair of hollow tubes each having an included angle between its longitudinal axis and the lower surface of each of said two widthwise extending side members of about 144 degrees and an included angle between its longitudinal axis and the lower surface of one of said two lengthwise extending side members of about 102 degrees;

said second pair of hollow tubes each having an included angle between its longitudinal axis and said lower surface of each of said two widthwise extending side members of about 56 degrees and an included angle between its longitudinal axis and the lower surface of the other of said two lengthwise extending side members of about 97.5 degrees; and a leg in each of said first and second pairs of hollow tubes so that said transparent panel may be used as a book holder for reading in bed.

8. Apparatus as in claim 7 wherein:

each of said legs extending at said included angles of about 144 degrees and 102 degrees having a length of between about 11 and 15 inches; and each of said legs extending at said included angles of about 56 degrees and 97.5 degrees having a length of between about 19 and 23 inches.

9. Apparatus as in claim 7 wherein:

each of said legs extending at said included angles of about 144 degrees and 102 degrees having a length of about 13 inches: and each of said legs extending at said included angles of about 56 degrees and 97.5 degrees having a length of about 21 inches.

10. Apparatus as in claim 5 wherein:

said third pair of hollow tubes each having an included angle between its longitudinal axis and the plane in which the lower surface of each of said two widthwise extending side members lies of between about 75.4 degrees and 85.4 degrees and an included angle between its longitudinal axis and the lower surface of one of said two lengthwise extending side members of between about 89 degrees and 91 degrees;

said fourth pair of hollow tubes each having an included angle between its longitudinal axis and the plane in which the lower surface of each of said two widthwise extending side members lies of between about 94.6 degrees and 104.6 degrees and an included angle between its longitudinal axis and the lower surface of the other of said two lengthwise extending side members of between about 89 degrees and 91 degrees; and a leg in each of said third and fourth pairs of hollow tubes so that said transparent panel may be used as a lap writing surface.

11. Apparatus as in claim 5 wherein:

said third pair of hollow tubes each having an included angle between its longitudinal axis and the plane in which the lower surface of each of said two widthwise extending side members lies of about 80.4 degrees and an included angle between its longitudinal axis and the lower surface of one of said two lengthwise extending side members of about 90 degrees;

said fourth pair of hollow tubes each having an included angle between its longitudinal axis and the plane in which the lower surface of each of said two widthwise extending side members lies of about 99.6 degrees and an included angle between its longitudinal axis and the lower surface of the other of said two lengthwise extending side members of about 90 degrees; and a leg in each of said third and fourth pairs of hollow tubes so that said transparent panel may be used as a lap writing surface.

12. Apparatus as in claim 11 wherein:

each of said legs extending at said included angles of about 80.4 degrees and 99.6 degrees having a length of between about 9 and 13 inches; and each of said legs extending at said included angles of about 90 degrees and 90 degrees having a length of between about 7 and 11 inches.

13. Apparatus as in claim 11 wherein:

each of said legs extending at said included angles of about 80.4 degrees and 99.6 degrees having a length of about 11 inches; and each of said legs extending at said included angles of about 90 degrees and 90 degrees having a length of about 9 inches.

14. Apparatus as in claim 5 and further comprising:

each of said legs is hollow; and each of said hollow legs having at its other end an enlarged inner diameter so that said one end of another hollow leg may be inserted therein and be frictionally retained therein.

15. Apparatus as in claim 14 wherein said legs comprise:

two legs, each having a length of about four inches;

two legs, each having a length of about nine inches;

two legs, each having a length of about ten inches; and two legs, each having a length of about eleven inches.

16. Apparatus as in claim 5 wherein:

said first pair of hollow tubes each having an included angle between its longitudinal axis and the lower surface of each of said two widthwise extending side members of between about 139 degrees and 149 degrees and an included angle between its longitudinal axis and the lower surface of one of said two lengthwise extending side members of between about 97 degrees and 107 degrees;

said second pair of hollow tubes each having an included angle between its longitudinal axis and said lower surface of each of said two widthwise extending side members of between about 51 degrees and 61 degrees and an included angle between its longitudinal axis and the lower surface of the other of said two lengthwise extending side members of between about 92.5 degrees and 102.5 degrees;

said third pair of hollow tubes each having an included angle between its longitudinal axis and the plane in which the lower surface of each of said two widthwise extending side members lies of between about 75.4 degrees and 85.4 degrees and an included angle between its longitudinal axis and the lower surface of one of said two lengthwise extending side members of between about 89 degrees and 91 degrees; and said fourth pair of hollow tubes each having an included angle between its longitudinal axis and the plane in which the lower surface of each of said two widthwise extending side members lies of between about 94.6 degrees and 104.6 degrees and an included angle between its longitudinal axis and the lower surface of the other of said two lengthwise extending side members of between about 89 degrees and 91 degrees.

17. Apparatus as in claim 5 wherein:

said first pair of hollow tubes each having an included angle between its longitudinal axis and the lower surface of each of said two widthwise extending side members of about 144 degrees and an included angle between its longitudinal axis and the lower surface of one of said two lengthwise extending side members of about 102 degrees;

said second pair of hollow tubes each having an included angle between its longitudinal axis and said lower surface of each of said two widthwise extending side members of about 56 degrees and an included angle between its longitudinal axis and the lower surface of the other of said two lengthwise extending side members of about 97.5 degrees;

said third pair of hollow tubes each having an included angle between its longitudinal axis of the plane in which the lower surface of each of said two widthwise extending side members lies of about 80.4 degrees and an included angle between its longitudinal axis and the lower surface of one of said two lengthwise extending side members of about 90 degrees; and said fourth pair of hollow tubes each having an included angle between its longitudinal axis and the plane in which the lower surface of each of said two widthwise extending side members lies of about 99.6 degrees and an included angle between its longitudinal axis and the lower surface of the other of said two lengthwise extending side members of about 90 degrees.

18. Apparatus as in claim 17 wherein:

said frame has a length of about 19 inches and a width of about 14 inches.

19. Apparatus as in claim 18 wherein:

said first lengthwise support flange extends upwardly for a distance of about 1.0 inch; and said second lengthwise support flange extends upwardly for a distance of about 0.5 inch.

20. Apparatus as in claim 19 wherein:

each of said hollow tubes has a generally cylindrical inner surface;

said one end of each of said legs has a generally cylindrical outer surface; and the other end of each of said legs being flared outwardly so that the inner diameter thereof is slightly greater than the outer diameter of said one end so that one leg may be mounted on another leg.

* * * * *

UNITED STATES PATENT AND TRADEMARK OFFICE

CERTIFICATE OF CORRECTION

PATENT NO. : 4,718,630

DATED : January 12, 1988

INVENTOR(S) : Betty A. Richards

It is certified that error appears in the above-identified patent and that said Letters Patent is hereby corrected as shown below:

Title Page Delete "Richard" and insert therefor --Richards-- (two occurrences)

Col. 1, line 59 delete "sid" and insert therefor --side--

Col. 5, line 6 delete "4" and insert therefor --64--.

Signed and Sealed this

Twenty-first Day of May, 1991

*Attest:*

HARRY F. MANBECK, JR.

*Attesting Officer*

*Commissioner of Patents and Trademarks*